US006242695B1

(12) United States Patent
Daoud

(10) Patent No.: US 6,242,695 B1
(45) Date of Patent: Jun. 5, 2001

(54) CONNECTOR WITH COLLAPSIBLE WALLS

(75) Inventor: Bassel H. Daoud, Parsippany, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/404,169

(22) Filed: Sep. 24, 1999

(51) Int. Cl.[7] ..... H01H 21/04

(52) U.S. Cl. ..... 174/57; 174/50; 174/67; 220/3.3; 220/3.2; 220/3.7

(58) Field of Search ..... 174/39, 50, 53, 174/57, 67; 220/3.3, 3.2, 3.7; 439/76.2, 57, 83, 344, 533, 534, 535, 536, 596, 676; 211/169.1; 108/134; D8/323

(56) References Cited

U.S. PATENT DOCUMENTS 1,909,136 * 5/1933 Thomas, Jr. ..... 174/50
3,584,136 * 6/1971 Robert ..... 174/53
4,134,516 * 1/1979 Sullo ..... 174/67
4,156,998 * 6/1979 McClure ..... 174/50
5,017,164 * 5/1991 Gibbs ..... 439/83
5,148,962 * 9/1992 Jones et al. ..... 439/83
5,196,988 * 3/1993 Horn ..... 174/50
5,984,720 * 11/1999 Milner et al. ..... 439/534
6,083,032 * 7/2000 Daoud ..... 439/589
6,102,729 * 8/2000 Daoud ..... 439/402

* cited by examiner

*Primary Examiner*—Dean A. Reichard
*Assistant Examiner*—Angel R. Estrada
(74) *Attorney, Agent, or Firm*—David L. Davis

(57) ABSTRACT

A connector which allows wave soldering of terminals followed by the application of potting material over the terminals, including a base holding the terminals and wall segments hingedly secured to the base surrounding the terminals. For the wave soldering operation, the wall segments are pivoted away from the terminals to be substantially parallel to the base. After the wave soldering operation, the wall segments are pivoted toward the terminals to form a wall surrounding the terminals for containing potting material.

6 Claims, 3 Drawing Sheets

10
12
14
16
18
20
22
24
26
27
28
30
32
34
36
38
40
46

10
12
14
16
18
20
22
24
26
27
28
30
32
34
36
38
40
46
48
50

10
12
14
16
18
20
22
24
26
27
30
32
34
38
40
42
44
46
48
50

CONNECTOR WITH COLLAPSIBLE WALLS

BACKGROUND OF THE INVENTION

This invention relates to a connector particularly suitable for use in a building entrance box and, more particularly, to such a connector having collapsible walls to allow a wave soldering operation without damaging the connector plastic and to thereafter allow a potting operation.

Where telephone wires enter a building, there is usually provided a building entrance box. The incoming wires, which are typically contained within one or more multi-wire cables, enter a splice chamber in the box, where they are connected to wires which go to a protector field, in a connector chamber of the box, providing protection against lightning, high voltage and high current, and then connections are made within the connector chamber to an output wire connector field. At the connector field, connections are made to wires which extend through the building to output jacks at various locations in the building. Accordingly, a connector is provided within the connector chamber.

When such a box is us in an outdoor environment, moisture can enter the box through openings provided for the incoming cables. This moisture can pass from the splice chamber to the connector chamber and can condense on the underside of the connector field, where it can short out terminals. To prevent such problems, in the past the underside of the connector field has been potted. Such potting requires a wall surrounding the region being potted in order to contain the potting material. However, connectors designed for wave soldering of their terminals must have the terminal tails fully exposed. The plastic housing of the connector must be isolated from the tails in order to prevent molten solder from touching and burning the plastic. However, this conflicts with the requirement that there be a wall around the terminal tails for containing the potting material. Accordingly, it would be desirable to provide a connector which can be used in a wave solder procedure and which allows the terminals to be potted after the wave solder procedure.

SUMMARY OF THE INVENTION

According to the present invention, there is provided a connector having a substantially planar and rectangular insulative base adapted to hold a plurality of elongated two-ended conductive terminals in a parallel spaced array with the axes of the terminals orthogonal to the base and with the first ends of all of the terminals extending outwardly from a first side of the base and the second ends of all of the terminals extending outwardly from a second side of the base. Four insulative wall segments are hingedly secured to the first side of the base. Each wall segment is movable between a first orientation substantially parallel to the first side of the base and a second orientation substantially orthogonal to the first side of the base. When the four wall segments are in their second orientations, they form a wall surrounding the first ends of all of the terminals. Each wall segment terminates in a respective distal edge which is further from the first side of the base than the first ends of all of the terminals when the wall segments are in their second orientations.

In accordance with an aspect of this invention, each of the wall segments is coupled to the first side of the base through a respective living hinge.

In accordance with another aspect of this invention, adjacent wall segments are formed with complementary snap-fit features to retain the wall segments in their second orientations.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figures 1, 2:
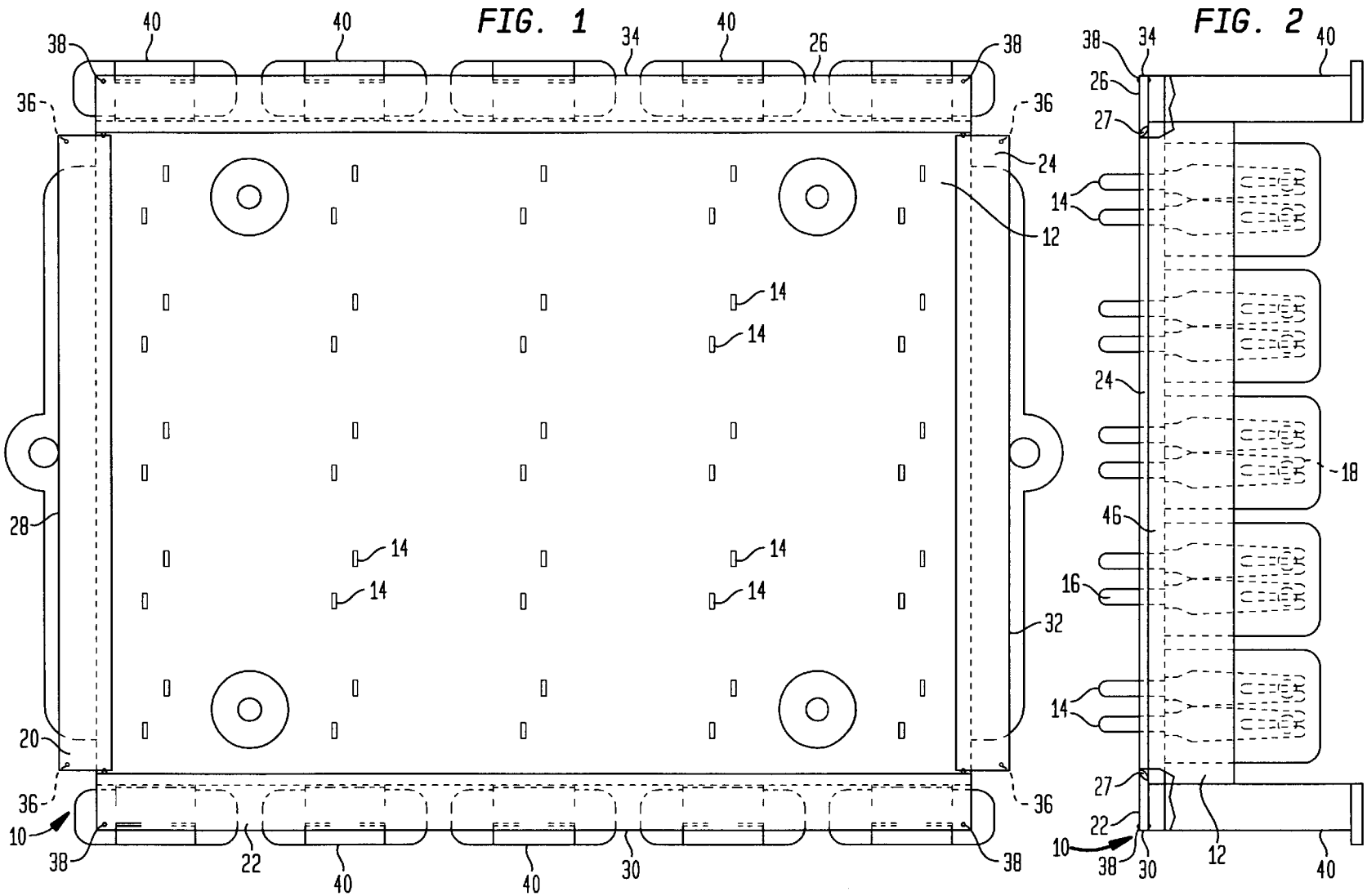
FIG. 1 is a plan view of an illustrative embodiment of a connector constructed in accordance with the principles of this invention showing the wall segments in their first orientation.
FIG. 2 is an end view, partially cut away, of the connector shown in FIG. 1.

Referring to the drawings, the inventive connector, designated generally by the reference numeral 10, includes a substantially planar and rectangular insulative base 12 which is adapted to hold a plurality of elongated two-ended conductive terminals 14 in a parallel spaced array. Each of the terminals has a first end 16 and a second end 18 along a longitudinal axis of the terminal. The base 12 holds the terminals 14 with the axes of the terminals 14 orthogonal to the base 12 and with the first ends 16 of all of the terminals 14 extending outwardly from a first side of the base 12 and the second ends 18 of all of the terminals 14 extending outwardly from a second side of the base 12.

Figures 5, 6:
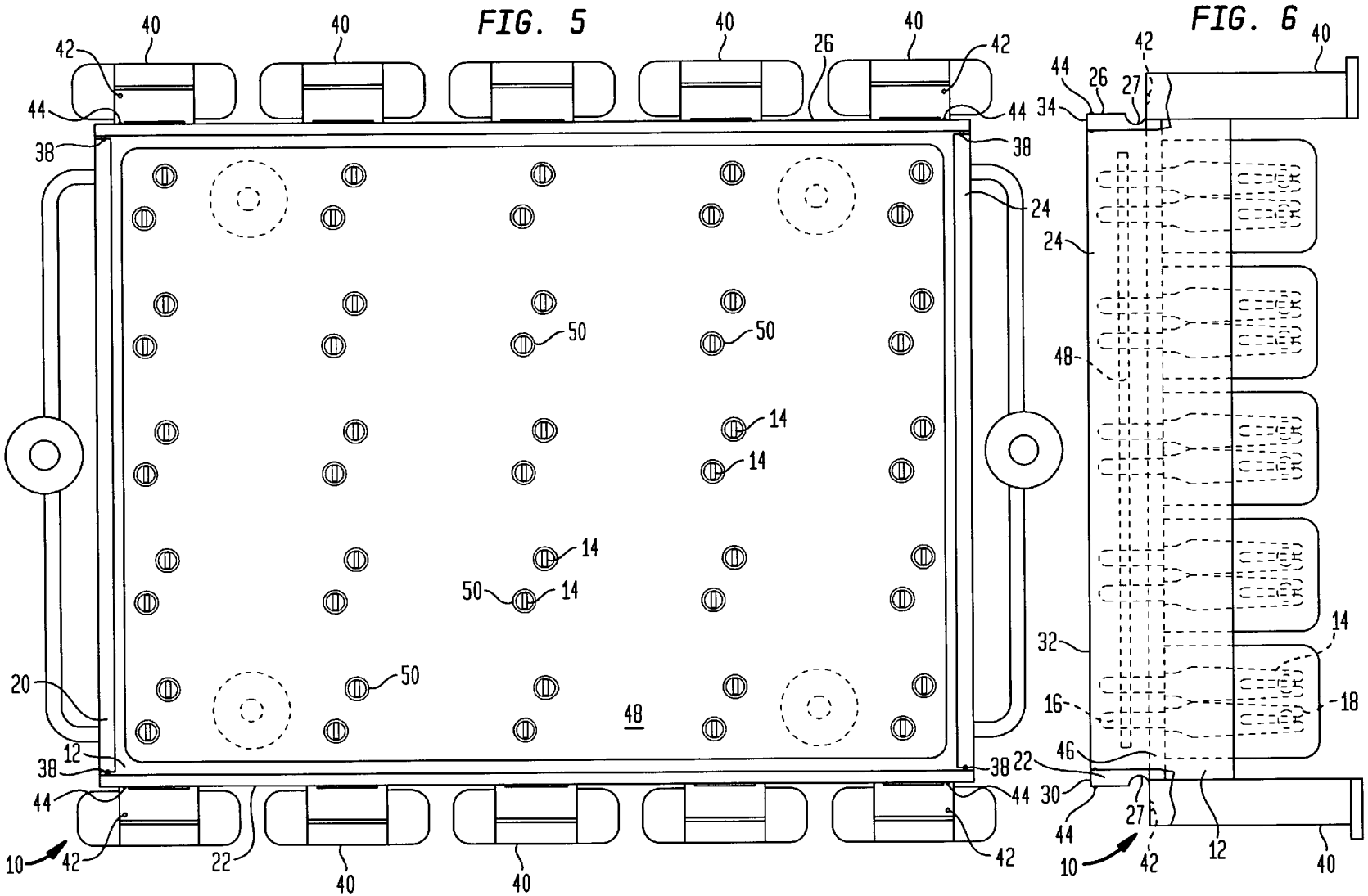
FIG. 5 is a plan view of the connector shown in FIG. 3 with the wall segments in their second orientations.
FIG. 6 is an end view, partially cut away, of the connector shown in FIG. 5.

The connector 10 further includes four wall segments 20, 22, 24, 26 which are hingedly secured to the first side of the base 12, preferably by a respective living hinge 27. Each wall segment 20, 22, 24, 26 is movable between a first orientation substantially parallel to the first side of the base 12, as shown in FIGS. 1–4, and a second orientation substantially orthogonal to the first side of the base 12, as shown in FIGS. 5 and 6. As shown in FIGS. 5 and 6, when the wall segments 20, 22, 24, 26 are in their second orientations, they form a wall surrounding the first ends 16 of all of the terminals 14. Each of the wall segments 20, 22, 24, 26 terminates in a respective distal edge 28, 30, 32, 34 which is further from the first side of the base 12 than the first ends 16 of all of the terminals 14, as best seen in FIG. 6. To retain the wall segments 20, 22, 24, 26 in their second orientations, as shown in FIGS. 5 and 6, adjacent wall segments are formed with complementary snap-fit features. Thus, the wall segments 20, 24 have dimples 36 on their edges and the adjacent wall segments 22, 26 have knobs 38 which snap-fit into respective dimples 36.

Figures 3, 4:
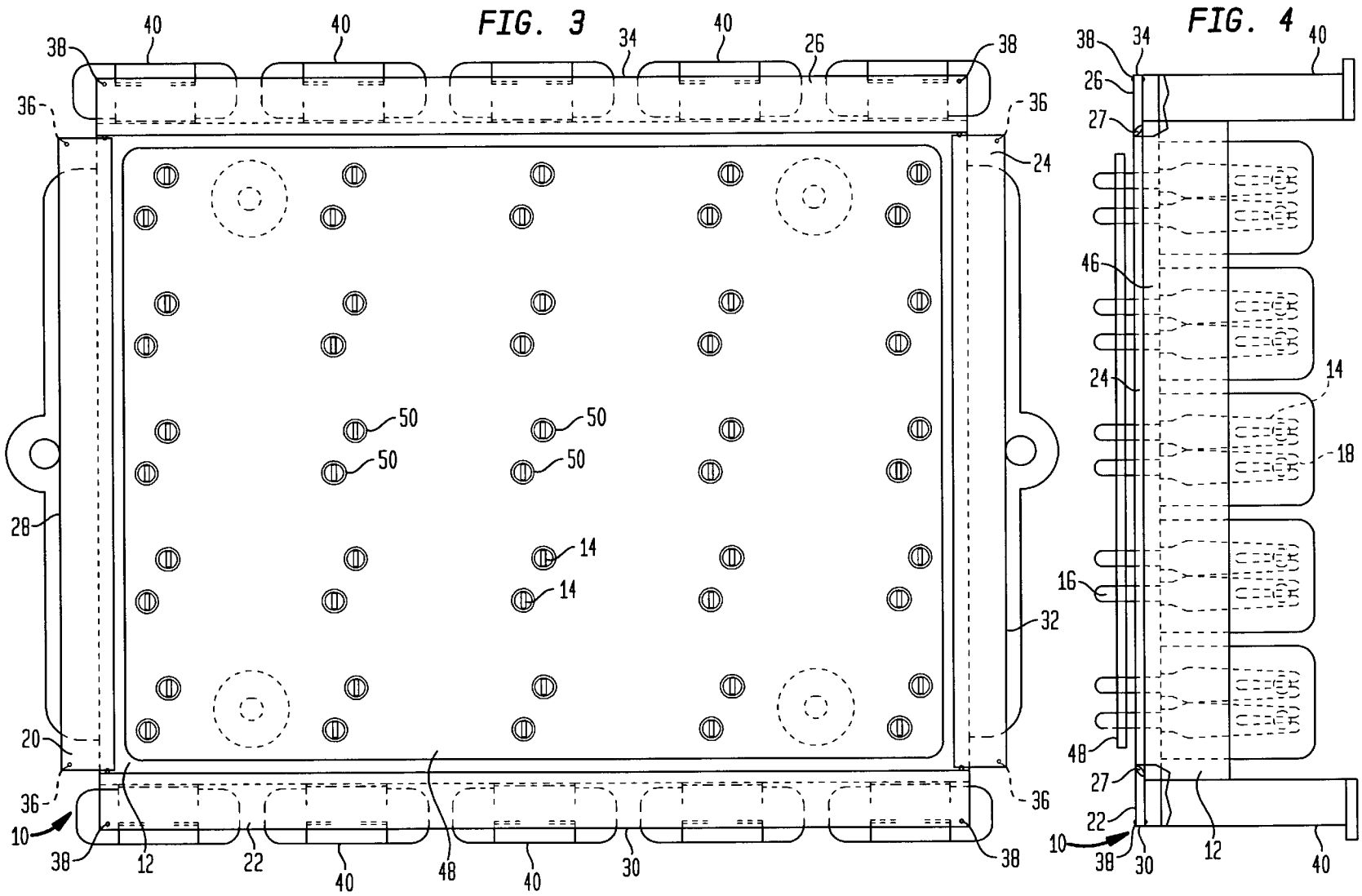
FIG. 3 is a plan view of the connector shown in FIG. 1 with the addition of a printing wiring board.
FIG. 4 is an end view, partially cut away, of the connector shown in FIG. 3.

The connector 10 further comprises a plurality of support members 40 which extend outwardly from the base 12 and beyond the second ends 18 of all of the terminals 14, as best seen in FIGS. 2, 4 and 6. To retain the wall segments 20, 22, 24, 26 in their first orientations, the wall segments 20, 22, 24, 26 and selected ones of the support members 40 are formed with complementary snap-fit features. Thus, for example, selected ones of the support members 40 are formed with dimples 42 and the wall segments 22, 24 are formed on their sides with knobs 44 which snap-fit into respective dimples 42.

In the embodiment shown in the drawings, the base 12 includes an insulative fixed wall 46 at the periphery of the first side of the base 12 and extending substantially orthogonally to the first side of the base 12 to surround the first ends 16 of all of the terminals 14. The fixed wall 46 terminates in a distal edge lying in a plane parallel to the first side of the base 12 and closer to the first side of the base 12 than the first ends 16 of all of the terminals 14. Each of the wall segments 20, 22, 24, 26 is hingedly secured, preferably by the living hinge 27, to the distal edge of the fixed wall 46.

In use, the terminals 14 are installed in the base 12, in suitable openings provided therefor. Then a printed wiring board 48, having plated through-holes 50 is placed over the first ends 16 of the terminals 14. With the wall segments 20, 22, 24, 26 in their first orientation, as shown in FIGS. 3 and 4, a wave soldering operation is performed to solder the terminals 14 to respective ones of the plated through-holes 50. As best shown in FIG. 4, the first ends 16 of the terminals 14 and the printed wiring board 48 are spaced from the plastic of the connector 10, so that the wave soldering operation is isolated from the plastic of the connector 10. If the connector 10 is being used in an outdoor environment, the printed wiring board 48 can fail unless it gets additional protection by being covered by potting material. In this case, the wall segments 20, 22, 24, 26 are pivoted to their second orientations, as best shown in FIGS. 5 and 6, and potting material is applied to cover the printed wiring board 48 and the first ends 16 of the terminals 14, with the wall segments 20, 22, 24, 26 capturing the potting material so that it can cure.

Although the connector 10 was designed to solve a problem associated with the conflict between wave soldering and potting, the disclosed connector can also be used where the first ends 16 of the terminals 14 are wire wrapped, without requiring a redesign of the connector 10.

Accordingly, there has been disclosed an improved connector which is usable for potting after a wave soldering operation. While an illustrative embodiment of the present invention has been disclosed herein, it is understood that various adaptations and modifications to the disclosed embodiment are possible and it is intended that this invention be limited only by the scope of the appended claims.

What is claimed is:

1. A connector comprising:

a substantially planar and rectangular insulative base adapted to hold a plurality of elongated two-ended conductive terminals in a parallel spaced array with the axes of the terminals orthogonal to the base and with the first ends of all of the terminals extending outwardly from a first side of the base and the second ends of all of the terminals extending outwardly from a second side of the base; and four insulative wall segments hingedly secured to the first side of the base and each movable between a first orientation substantially parallel to the first side of the base and a second orientation substantially orthogonal to the first side of the base;

wherein when the four wall segments are in their second orientations they form a wall surrounding the first ends of all of the terminals with each wall segment terminating in a respective distal edge which is further from the first side of the base than the first ends of all of the terminals.

2. The connector according to claim 1 wherein each of the wall segments is coupled to the first side of the base through a respective living hinge.

3. The connector according to claim 1 wherein adjacent ones of said wall segments are formed with complementary snap-fit features to retain the wall segments in their second orientations.

4. The connector according to claim 1 further comprising a plurality of support members extending outwardly from said base and beyond the second ends of all of the terminals, and wherein the wall segments and the support members are formed with complementary snap-fit features to retain the wall segments in their first orientations.

5. The connector according to claim 1 wherein:

the base further includes an insulative fixed wall on the first side of the base and extending substantially orthogonally to the first side of the base to surround the first ends of all of the terminals, the fixed wall terminating in a distal edge lying in a plane parallel to the first side of the base and closer to the first side of the base than the first ends of all of the terminals; and each of the wall segments is hingedly secured to the distal edge of the fixed wall.

6. The connector according to claim 5 wherein each of the wall segments is coupled to the distal edge of the fixed wall through a respective living hinge.

* * * * *